US007578113B2

(12) United States Patent
Lim et al.

(10) Patent No.: US 7,578,113 B2
(45) Date of Patent: Aug. 25, 2009

(54) METHOD AND APPARATUS FOR PACKAGING SIDE OPENING CIGARETTE PACKETS

(75) Inventors: Edwin Cheng Siew Lim, Singapore (SG); Eric C L Kuek, Singapore (SG); Zhong Hai Yang, Singapore (SG); Kia Swee Tan, Singapore (SG)

(73) Assignee: British-American Tobacco (Singapore) Private Limited, Singapore (SG)

( * ) Notice: Subject to any disclaimer, the term of this patent is extended or adjusted under 35 U.S.C. 154(b) by 159 days.

(21) Appl. No.: 11/632,750

(22) PCT Filed: Jul. 20, 2005

(86) PCT No.: PCT/IB2005/002322

§ 371 (c)(1),
(2), (4) Date: Jun. 16, 2007

(87) PCT Pub. No.: WO2006/011056

PCT Pub. Date: Feb. 2, 2006

(65) Prior Publication Data

US 2007/0294981 A1 Dec. 27, 2007

(30) Foreign Application Priority Data

Jul. 24, 2004 (GB) ..... 0416562.7

(51) Int. Cl.
*B65B 19/18* (2006.01)

(52) U.S. Cl. ..... 53/444; 53/148

(58) Field of Classification Search ..... 53/444, 53/147, 148, 449, 228, 220, 234, 575
See application file for complete search history.

(56) References Cited

U.S. PATENT DOCUMENTS

| | | | | |
|---|---|---|---|---|
| 3,924,386 | A * | 12/1975 | Schmermund | 53/136.4 |
| 4,004,395 | A * | 1/1977 | Bardenhagen et al. | 53/396 |
| 4,476,665 | A * | 10/1984 | Oberdorf | 53/575 |
| 5,996,309 | A * | 12/1999 | Focke et al. | 53/228 |
| 6,173,551 | B1 * | 1/2001 | Bowman et al. | 53/131.4 |
| 6,381,920 | B1 * | 5/2002 | Bailey et al. | 53/234 |
| 6,550,220 | B1 * | 4/2003 | Focke et al. | 53/396 |

* cited by examiner

*Primary Examiner*—Thanh K Truong
(74) *Attorney, Agent, or Firm*—Charles Sherman; Middleton Reutlinger

(57) ABSTRACT

A method and a device of constructing a side-opening cigarette package. The method comprises gathering cigarettes into a bundled charge. A flat shell (10) is propped open to facilitate insertion of the bundled cigarettes. The shell containing the cigarettes is rotated and placed in a desired orientation onto a blank. The blank is folded to form the side opening cigarette package.

10 Claims, 3 Drawing Sheets

METHOD AND APPARATUS FOR PACKAGING SIDE OPENING CIGARETTE PACKETS

CROSS REFERENCE TO PRIOR APPLICATION

This application is a national stage filing (35 U.S.C. 371) of PCT/IB2005/002322, filed on Jul. 20, 2005, which claims priority to and benefit from Great Britain Patent Application No. 0416562.7, filed on Jul. 24, 2004, currently pending.

FIELD OF INVENTION

This invention relates to the packaging of cigarettes, and in particular the method and apparatus used in placing individual cigarettes into packets ready for storage, shipping and sale.

While the invention is particularly suited for use with cigarettes, other elongate tobacco products are equally applicable, including cigarette filter rods, cigars, or cigarillos. Said products will collectively be referred to as "cigarettes".

BACKGROUND OF THE INVENTION

One cigarette pack of the art is the so called hard-pack, which is essentially a pack with a hinged lid, where the cigarettes are positioned in the pack transverse to the axis of the hinge. A further known cigarette pack is the so called soft-pack, which is a pack with no lid, where the axis of the cigarettes is positioned in the pack parallel to the major axis of the pack. These cigarettes are typically wrapped in a metal, metal laminate or metallic coated paper, normally termed as a foil, which is sealed around the "charge" of cigarettes.

When the top is opened by rotation about the hinge line (for hard-pack types) or by removal of a wrapper (for soft-pack types), the user sees the circular ends of the array of cigarettes. Each cigarette is removed from the pack by withdrawal along its axis, parallel to the major axis of the cigarette pack.

An alternative arrangement is the "slide and shell" cigarette packs, in which one or more groups of cigarettes wrapped in foil are contained in a tray-like slide received in a rectangular sleeve.

In the arrangement of the present invention, cigarettes are positioned with their axes parallel to the axis of a hinge of a lid of the pack. A cigarette pack with cigarettes held in a pack parallel to a hinge axis between its halves and which when opened exposes the interior of both halves to the user, is disclosed in DE-A-3345586, the contents of which are incorporated herein by reference. U.S. Pat. No. 6,435,342 also discloses a package for cigarettes, the contents of this US patent being incorporated herein by reference. The pack of U.S. Pat. No. 6,435,342 has a similar action to the conventional hard-pack type with the axes of the hinge parallel to the axis of the cigarettes enclosed within. These types of cigarette packs allow the user to draw out the cigarettes more easily.

Current cigarette packaging machines pack cigarettes into conventional cigarette packages that open from the top. The "Shell-and-Slide" packer bundles cigarettes into a tray-like slide, and slides this into a rectangular sleeve.

Current side-opening cigarettes broadly fall into two categories.

(i) Sliding of an inner sleeve laterally out from the outer sleeve pocket; pivotal motion where the inner sleeve pivots on the outer sleeve to allow the inner sleeve to be tipped out; and (ii) side hinge motion, where the package is opened by the side, much like a book.

While these types of packages may be broadly termed as side opening packages, the cigarettes are not drawn out from the side, but rather, from the major axis of the cigarette packs.

The prior art does not disclose cigarette-packaging machine, or other automated method, which packs cigarettes into packages that allow the user to draw out the cigarettes from the side. Packaging into such packages is presently done manually. Manual packaging processes are time-consuming and labour intensive, and this will ultimately affect production, turnaround time and the economic viability of this form of cigarette packaging. Also, due to the mundane nature, the packaging process will also be prone to human error in that the number of cigarettes packed into each package may differ. This will ultimately affect the quality of the process, and deter conformance to international quality standards. To comply with these standards, an additional step or additional means to determine the number of cigarette sticks in each package may need to be introduced.

Where manual handling is concerned, human contamination may be introduced within the cigarette packs, which may also pose a health risk.

With the delicate nature of the cigarette sticks, damage to the sticks may also occur, including defect rates and wastage. This may once again be a quality concern to the cigarette packaging process.

It follows that there is a need for an efficient packaging system to minimise the production time, health and quality problems that the present packaging process provides.

SUMMARY OF INVENTION

According to a first aspect of the present invention, there is provided a method of constructing a cigarette package including the steps of gathering a pre-determined number of cigarettes into a bundled charge; propping open a flat shell to form an insert; inserting said charge longitudinally into said insert; rotating said insert through 90 degrees; placing the insert onto a blank; and folding the blank to form a side opening cigarette package.

Preferably, the rotating step includes translating the insert to a point adjacent the outer shell.

Still preferably, the method further includes the step of wrapping the charge in a foil prior to inserting said charge.

In another preferred embodiment of the present invention, the method further includes the step of bonding the insert to the blank prior to folding the blank to form a side opening cigarette package.

Preferably, the method further includes the step of folding fins connected to the insert so as prevent cigarettes dropping out of the insert following inserting the charge into the insert.

According to a second aspect of the present invention, there is provided a device for constructing a cigarette package including a gathering means for gathering a pre-determined number of cigarettes into a bundled charge; a propping means for propping open a flat shell to form an insert; an insertion means for inserting said charge longitudinally into said insert; a rotation means for rotating said insert through 90 degrees; a placing means to place said insert onto a blank; and a folding means to fold said blank to form a side opening cigarette package.

Preferably, the device further includes a translation means for translating the insert to a point at which it is placed onto a blank.

Still preferably, the translation means and rotation means are combined.

In yet another preferred embodiment, the translation and rotation means is a mechanically driven lever arm having means to engage the insert and simultaneously rotate and translate the insert to the point of insertion into the outer shell.

Preferably, the insertion, translation and rotation means include a linear actuator motivated by any one or a combination of electronic, hydraulic, pneumatic or chain driven motivation sources.

DETAILED DESCRIPTION OF INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention.

However, it will be obvious to one of ordinary skill of the art that the present invention may be practiced without these specific details. In other instances, well known methods, procedures, components, and features have been described in detail as not to unnecessarily obscure aspects of the present invention.

Figure 1:
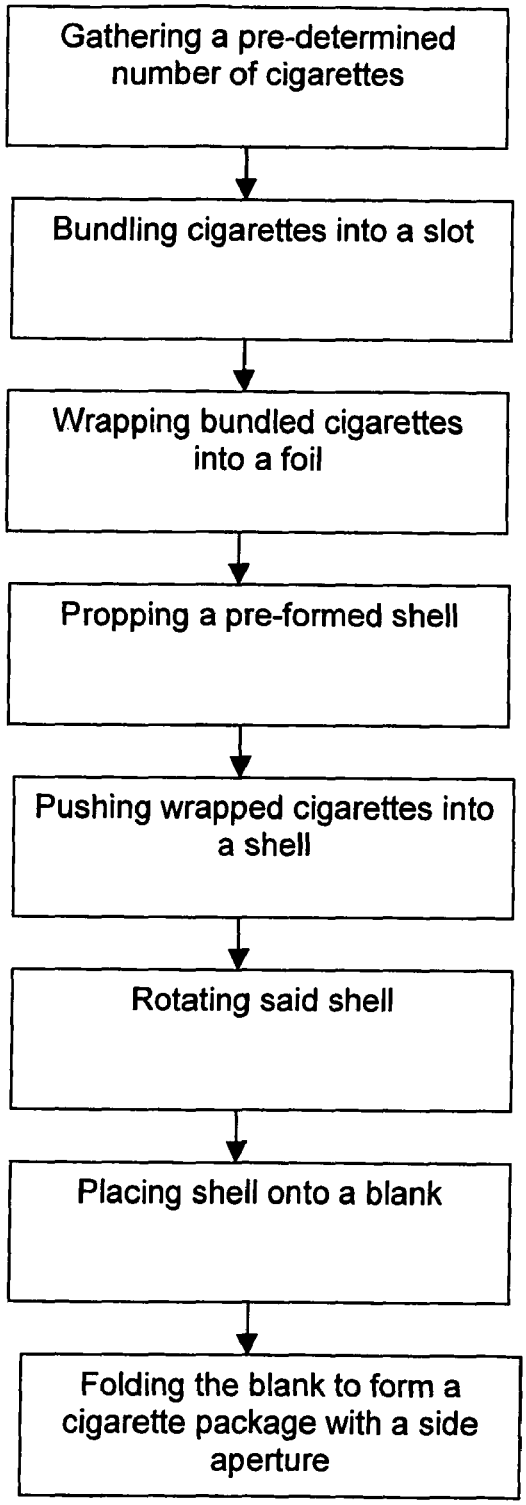
FIG. 1 shows the process flow for packaging cigarettes

FIG. 1 shows the flowchart of the process for cigarette packaging into side opening cigarette packs of the current invention. Loose cigarettes are first introduced into the packaging machine where they are then bundled together into a mechanical slot and are then wrapped with a foil. This foil can either be a metal, metal laminate or metallic coated paper.

Figure 2:
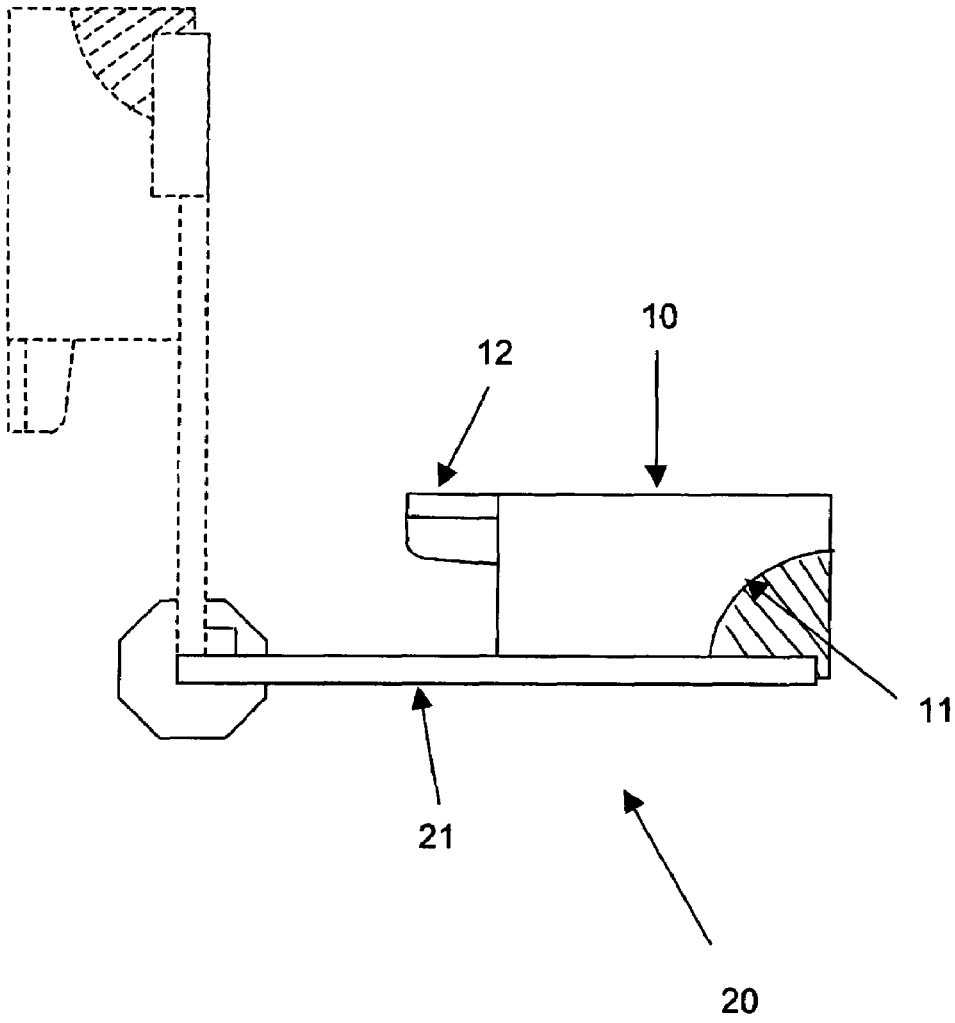
FIG. 2 shows the rotational aspect of the cigarette packaging machine

It is to be appreciated that side opening packages are generally bigger and broader than conventional packages that open from the top. Thus, when the cigarettes are wrapped in foil, the score lines are not of the conventional dimension. As seen in FIG. 2, the wrapped bundle is "pushed" into a pre-formed shell 10. This pre-formed shell 10 is first laid flat to provide ease of storage and delivery into the packaging process. A shell forming and pushing mechanism props up the flat, pre-formed shell 10 and the cigarettes that have been bundled in foil are then pushed into it using an insertion means. The cigarettes and shell 10 are then rotated transversely by a rotation means 20, adjacent the blank, before finally placing them on a blank. It is envisioned that should the blank be positioned further away from the rotation means 20, then a translation means 30 is desired to move the rotated cigarettes and shell 10 to the blank. It is to be understood that this translation means 30 can be of any means which will, in effect, translate the cigarettes and shell 10, to be placed in the blank by a placing means, not shown in the diagram. In a preferred embodiment, a mechanical arm 21 is used to provide this rotation. The blank is then folded to form a cigarette package with a side aperture.

The shell 10 used in this preferred embodiment is the shell as disclosed in U.S. Pat. No. 6,435,342. This shell 10 has two 'tail-like fins' 12 at the bottom end 14 while the top has an indentation 11 for users to extract cigarettes from the pack easily. The fins 12 prevent cigarettes from dropping out of the package, and also enhance the quality of the cigarettes enclosed. Further, it enhances the robustness of the cigarette package, and creates an aesthetic cigarette package. For menthol or flavoured type cigarettes, the inclusion of the fin 12 enables the menthol or flavoured vapour to be maintained within the shell 10 and cigarette package for a longer period of time.

Figure 3:
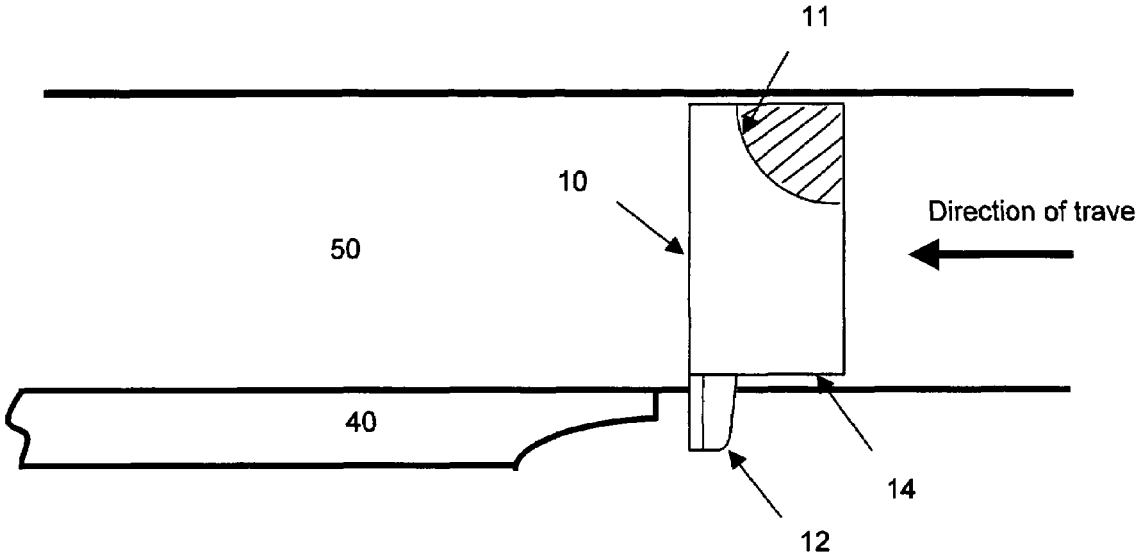
FIG. 3 shows the folding of the tail fin of the cigarette package

In a preferred embodiment, the process of folding in the fins 12 at one end is included within the packaging machine by a folding means 40. FIG. 3 shows the folding in of the fins 12. The charged bundle in the shell 10 with fins 12 are translated via a conveyor belt 50. As the shell 10 moves along, the fins 12 contact the folding means 40, which causes the fins 12 to be folded in, flush with the bottom of the shell 14. These cigarette packages then undergo a polywrapping process to maintain the freshness of its contents.

The invention claimed is:

1. A method of constructing a cigarette package including the steps of:

gathering a pre-determined number of cigarettes into a bundled charge;

providing an insert for containing said bundled charge;

inserting said bundled charge longitudinally into said insert;

rotating said insert containing said bundled charge through 90 degrees;

placing said insert containing said bundled charge onto a cigarette package blank; and folding said cigarette package blank about said insert containing said bundled charge to form a cigarette package.

2. The method according to claim 1 wherein said rotating step includes translating said insert containing said bundled charge to a point adjacent said cigarette package blank.

3. The method according to claim 1 farther including the step of wrapping said bundled charge in a foil prior to inserting said bundled charge into said insert.

4. The method according to claim 1 farther including the step of bonding said insert containing said bundled charge to said cigarette package blank prior to folding said blank to form a cigarette package.

5. The method according to claim 1 farther including the step of folding fins connected to said insert so as prevent cigarettes dropping out of said insert following the insertion of said bundled charge into said insert.

6. A device for constructing a cigarette package including:

a gathering means for gathering a pre-determined number of cigarettes into a bundled charge;

a means for providing an insert;

an insertion means for inserting said bundled charge longitudinally into said insert;

a rotation means for rotating said insert containing said bundled charge through 90 degrees;

a placing means to place said insert containing said bundled charge onto a cigarette package blank; and a folding means to fold said cigarette package blank about said insert containing said bundled charge to form a cigarette package.

7. The device according to claim 6 further including a translation means for translating said insert containing said bundled charge to a point at which it is placed onto said cigarette package blank.

8. The device according to claim 6 wherein said translation means and said rotation means are combined.

9. The device according to claim 8 wherein said translation means and said rotation means comprises a mechanically driven lever arm having means to engage said insert containing said bundled charge and simultaneously rotate and translate said insert containing said bundled charge to the point of placement onto said cigarette package blank.

10. The device according to claim 7 wherein said insertion, translation and rotation means comprise a linear actuator motivated by a motivation source selected from the group consisting of electronic, hydraulic, pneumatic or chain driven motivation sources or a combination thereof.

* * * * *